US005540044A

United States Patent [19]

Raasch

[11] Patent Number: 5,540,044

[45] Date of Patent: Jul. 30, 1996

[54] OPEN-END ROTOR SPINNING APPARATUS

[75] Inventor: Hans Raasch, Mönchengladbach, Germany

[73] Assignee: W. Schlafhorst AG & Co., Monchen-Gladbach, Germany

[21] Appl. No.: 413,246

[22] Filed: Mar. 30, 1995

[30] Foreign Application Priority Data

Mar. 31, 1994 [DE] Germany ..... 44 11 342.0

[51] Int. Cl.[6] ..... D01H 4/40

[52] U.S. Cl. ..... 57/417

[58] Field of Search ..... 57/417, 400, 404, 57/414

[56] References Cited

U.S. PATENT DOCUMENTS

| | | | |
|---|---|---|---|
| 3,163,976 | 1/1965 | Juillard | 57/417 X |
| 3,481,128 | 12/1969 | Landwehrkamp et al. | 57/417 |
| 4,044,537 | 8/1977 | Negishi et al. | 57/417 X |
| 4,625,506 | 12/1986 | Beckers | 57/417 X |
| 5,359,846 | 11/1994 | Miyamoto et al. | 57/417 |
| 5,406,783 | 4/1995 | Kaneko et al. | 57/417 |

FOREIGN PATENT DOCUMENTS

| | | |
|---|---|---|
| 1917864 | 12/1969 | Germany . |
| 2421415 | 11/1975 | Germany . |
| 2552955 | 8/1976 | Germany . |
| 3302676 | 4/1984 | Germany . |
| 4225087 | 2/1993 | Germany . |

*Primary Examiner*—Joseph J. Hail, III

*Attorney, Agent, or Firm*—Herbert L. Lerner; Laurence A. Greenberg

[57] ABSTRACT

An open-end spinning apparatus includes a rotor housing. A spinning rotor revolves in the rotor housing. A spinning insert is disposed coaxially to the rotor housing and is rotatably supported relative to the spinning rotor. The spinning insert has a yarn guide channel enabling entrainment of the spinning insert by a yarn during normal spinning operation. A coupling device fixes the spinning insert to the spinning rotor during a run-up of the rotor.

14 Claims, 3 Drawing Sheets

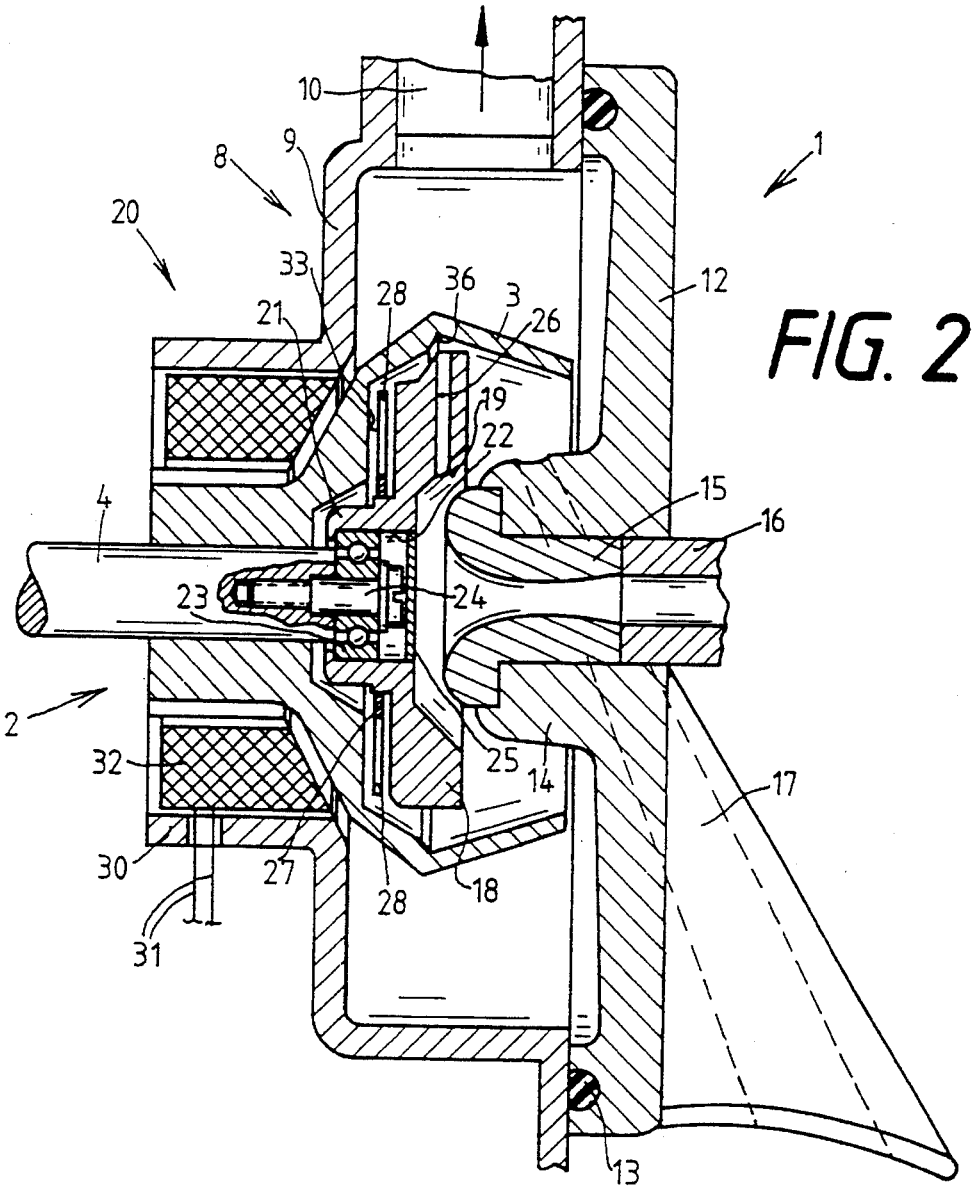
FIG. 2
FIG. 6
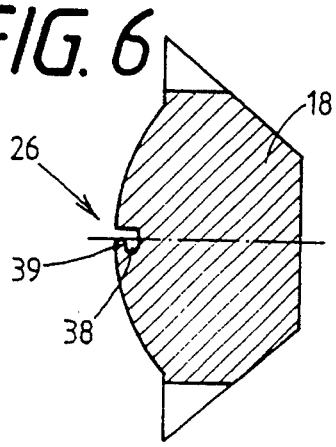
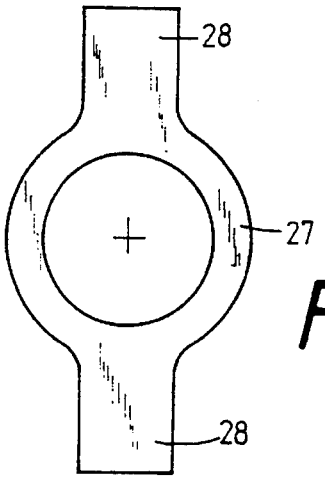
FIG. 5

OPEN-END ROTOR SPINNING APPARATUS

BACKGROUND OF THE INVENTION

1. Field of the Invention

The invention relates to an open-end spinning apparatus having a spinning rotor revolving in a rotor housing and a spinning insert being disposed coaxially to the rotor axis and being supported rotatably with respect to the spinning rotor.

German Published, Non-Prosecuted Application DE-OS 25 52 955 discloses an open-end spinning apparatus that has both a spinning rotor and a spinning insert supported rotatably inside the spinning rotor. The spinning rotor has a rotor shaft, constructed as a hollow shaft, that revolves on a support plate bearing. Inside the hollow shaft, a drive and bearing shaft of the spinning insert is supported in roller bearings.

The drive of the spinning rotor and the spinning insert is effected through a common tangential belt. In order to obtain the required differences in rotary speed between the spinning rotor and spinning insert in such rotor spinning apparatuses, drive wharves of the two shafts are dimensioned differently.

Open-end rotor spinning apparatuses conceived in that way have not proven themselves in practice.

A further development of the above-mentioned open-end rotor spinning apparatus is the subject of German Published, Non-Prosecuted Application DE 42 25 087 A1. In that known spinning apparatus as well, the spinning rotor with its rotor shaft constructed as a hollow shaft rests on a support disk bearing. Moreover, as described above, roller bearings are disposed inside the hollow shaft and receive the bearing shaft of a spinning insert. The bearing shaft of the spinning insert protrudes beyond the hollow shaft of the spinning rotor in the rear region and is supported through an axial bearing. The drive of the spinning rotor and of the spinning insert are each effected through a separate tangential belt. Since the circumferential speed of the spinning insert must be higher relative to the circumferential speed of the rotor groove by the amount of the yarn draw-off speed, it proves to be very complicated and expensive to control that kind of double drive, in which the speed ratios also change depending on the draw-off speed of the yarn.

It has also already been proposed (in German Published, Non-Prosecuted Application DE 33 02 676 A1) that a spinning insert rotatably supported in the spinning rotor be driven directly by the yarn. Despite the high rotor rpm, that is possible because the relative speed between the spinning rotor and the spinning insert is relatively low. However, in such an apparatus, problems arise in piecing.

Since the bearing of the spinning insert in the rotor must be constructed to run quite smoothly, so as not to put excess strain on the yarn as it entrains the spinning insert, the spinning insert remains far behind upon acceleration of the rotor and must be accelerated by the newly pieced yarn. In that process the yarn is often overloaded, and therefore the piecer fails.

SUMMARY OF THE INVENTION

It is accordingly an object of the invention to provide an open-end rotor spinning apparatus, which overcomes the hereinafore-mentioned disadvantages of the heretofore-known devices of this general type.

With the foregoing and other objects in view there is provided, in accordance with the invention, an open-end spinning apparatus, comprising a rotor housing; a spinning rotor revolving in the rotor housing; a spinning insert being disposed coaxially to the rotor housing and being rotatably supported relative to the spinning rotor, the spinning insert having a yarn guide channel enabling entrainment of the spinning insert by a yarn during normal spinning operation; and a coupling device for fixing the spinning insert to the spinning rotor during a run-up of the rotor.

In accordance with again another feature of the invention, the yarn guide channel has an entry side being curved in a direction of rotation of the spinning insert and has a drag groove for protected reception of a resultant yarn.

In accordance with again a further feature of the invention, there is provided a protrusion partly covering the drag groove of the yarn guide channel.

In accordance with again an added feature of the invention, the coupling device connects the spinning insert to the spinning rotor by frictional engagement during the run-up phase of the spinning rotor.

In accordance with again an additional feature of the invention, the spinning insert is freely rotatable inside the spinning rotor when the spinning apparatus is running at an operating rpm.

The spinning insert, which is freely rotatably supported in the spinning rotor and is fixable intermittently on the spinning rotor through the coupling device, offers the capability of spinning a rotor yarn that either reduces, or does not exhibit, the so-called ballooning that is typical of rotor yarn. The spinning insert prevents fiber web in the rotor groove, into which rotation is just being induced, from prematurely engaging further fibers, which are delivered continuously through the fiber guide conduit, and wrapping around the developing web.

The disposition of the coupling device according to the invention offers the advantage of permitting the spinning insert to be fixed intermittently to the spinning rotor. In this way, it is possible, in the acceleration phase of the spinning apparatus, to accelerate the spinning insert to the rotor rpm by means of the spinning rotor and thus to relieve the newly pieced yarn of this problematic task. The structure according to the invention results in a yarn of good quality as well as an apparatus with high piecing reliability.

Since the spinning insert is connected to the spinning rotor only during the relatively short run-up phase of the spinning rotor, yet beyond a certain rpm level it is freely rotatable within the spinning rotor, complicated and expensive control devices are not necessary. In this operating phase, the spinning insert is instead kept at the correct rpm level by the yarn. The circumferential speed of the spinning insert is established automatically by the circumferential speed of the rotor groove plus any yarn draw-off speed.

In accordance with another feature of the invention, the coupling device is constructed as a centrifugal coupling, which fixes the spinning insert on the spinning rotor up to a certain rpm level, and releases the spinning insert upon attainment of a certain threshold value.

In accordance with a further feature of the invention, the centrifugal coupling has a spring element secured to the rotor shaft with spring arms which rest on the spinning insert at a certain initial stress.

In accordance with an added feature of the invention, at higher rpm, the spring arms are bent outward under the influence of the mass centrifugal force, which is increasing quadratically, and are pressed against the back wall of the rotor. This kind of centrifugal coupling is economical to manufacture on one hand, and on the other hand is very reliable in its function.

In accordance with an additional feature of the invention, the coupling device is an electromagnet coupling.

In accordance with yet another feature of the invention, the coupling, which is triggerable in a defined manner, includes a switching magnet permanently installed on the rotor housing, and a ferromagnetic slaving element fixed to the spinning insert.

In accordance with yet a further feature of the invention, the slaving element, which is made of spring steel by way of example, has two flexible, radially outward-pointing slaving tongues. When current is supplied to the switching magnet, the slaving tongues are bent rearward and press against the back wall of the rotor. The spinning rotor and the spinning insert are then connected by frictional engagement.

In accordance with yet an added feature of the invention, the slaving tongues of the slaving element are diametrically opposed and are deflectable in a functional direction.

In particular, such a configuration has the advantage of permitting the length of time that the spinning insert is slaved by the rotor to be set in a defined manner and optionally to be easily corrected later.

In accordance with yet an additional feature of the invention, the spinning insert, which is freely rotatable inside the spinning rotor when the spinning apparatus is operating at its operating rpm, has a guide channel for the yarn to be drawn off. On one hand, such a guide channel has the advantage of assuring that the spinning insert will be reliably entrained by the yarn. On the other hand, the yarn is located in a relatively protected way, so that ballooning, which could occur as a result of the constantly newly fed-in fibers, is reliably avoided.

In accordance with a concomitant feature of the invention, there is provided a yarn draw-off nozzle protruding partly into a recess formed in a front surface of the spinning insert.

Other features which are considered as characteristic for the invention are set forth in the appended claims.

Although the invention is illustrated and described herein as embodied in an open-end rotor spinning apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2 is an enlarged, fragmentary, sectional view of a first embodiment of the invention, with an electromagnet coupling in the region of the spinning rotor;

FIG. 5 is a front-elevational view of a slaving element, shown in FIG. 3, of the electromagnet coupling; and FIG. 6 is a sectional view of the spinning insert taken along line VI—VI of FIG. 4, in the direction of the arrows.

DESCRIPTION OF THE PREFERRED EMBODIMENTS

Figure 1:
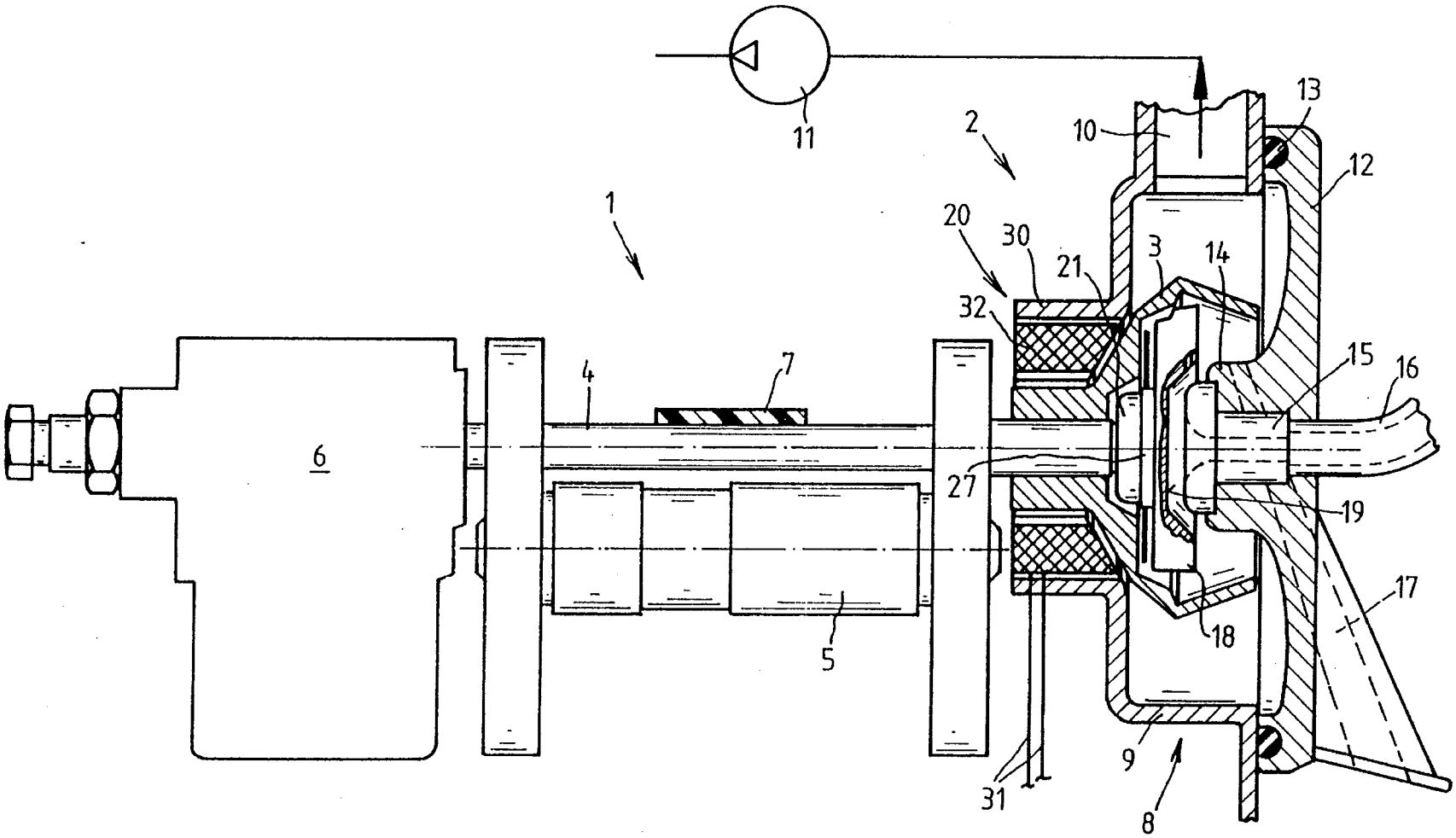
FIG. 1 is a fragmentary, diagrammatic, partly sectional, side-elevational view of an open-end rotor spinning apparatus with a spinning insert disposed inside the spinning rotor.

Referring now to the figures of the drawing in detail and first, particularly, to FIG. 1 thereof, there is seen a partly-sectional side view of an open-end rotor spinning apparatus 1. Such spinning apparatuses have a spinning rotor 2, which includes a rotor plate 3 and a rotor shaft 4. The rotor shaft 4 is supported in a support disk bearing 5 and is secured in the axial direction by a corresponding thrust bearing 6. The drive of the spinning rotor 2 is effected through an endless flat belt 7, which acts at a tangent upon the rotor shaft 4.

The rotor plate 3 revolves in a negative pressure chamber 8, which is formed by a rotor housing 9. The rotor housing 9 is connected through a negative pressure line 10 to a negative pressure source 11. The rotor housing 9, which is to be opened at the front, is closed in an airtight manner during a spinning operation by a channel plate 12, that has a ring seal 13. The channel plate 12 is interchangeably secured to a non-illustrated hinged cover and has a channel plate extension 14, in which a yarn draw-off nozzle 15 and a yarn draw-off tube 16 are positioned. A fiber guide channel 17 also ends in the channel plate extension 14, and by way of this channel individual fibers, which are combed from a sliver in an opening unit, are pneumatically fed into the rotor.

A spinning insert 18 is rotatably disposed on the rotor shaft 4 inside the rotor plate 3. As will be described in further detail below in conjunction with FIGS. 2 and 3, the spinning insert 18 can be fixed to the rotor plate 3 through a respective coupling device 20 and 29. The spinning insert 18 has a recess 19 in its front, into which the yarn draw-off nozzle 15 protrudes partway. A yarn guide channel 26 seen in FIGS. 2, 3 and 6 extends, substantially radially, from the recess 19. The yarn guide channel 26 has a slit drag groove 38 formed therein, which is slightly covered by a dog-like protrusion 39, as is seen in FIG. 6. The yarn guide channel 26 has an entry side being curved in a direction of rotation SR of the spinning insert 18 which is the same as a direction of rotation RR of the rotor, as is seen in FIG. 4. The spinning insert 18 also has a central bore 22 formed therein for receiving a roller bearing 23. The roller bearing 23 is fixed by its inner ring to the rotor shaft 4 by means of a screw bolt 24. The central bore 22 is closed in the bottom of the recess 19 by a cover disk 25.

In the embodiment of FIG. 2, the spinning insert 18 has an attachment 21 toward the rear, on which a slaving element 27, that is shown in a front view in FIG. 5, is fixed in such a manner as to prevent relative rotation. In the exemplary embodiment, the slaving, driving or carrier element 27 has two flexible radial slaving tongues 28. Since the slaving element 27 is preferably made of spring steel, when the slaving element 27 has been built in, the slaving tongues 28 can be deflected in the direction of the rotor axis. In this embodiment, a coupling device is constructed as the electromagnet coupling 20. The electromagnet coupling 20 has a magnet coil 32 that is let into a bearing attachment 30 of the rotor housing and can be supplied with current through connecting lines 31. When supplied with current, the magnetic field of the magnetic coil 32 deflects the slaving tongues 28 of the ferromagnetic slaving element 27 in the direction of a rear wall 33 of the rotor. In other words, the slaving tongues 28 are pressed against the rear wall 33 of the rotor. In this state, the spinning insert 18 is connected by frictional engagement to the spinning rotor 2.

Figure 3:
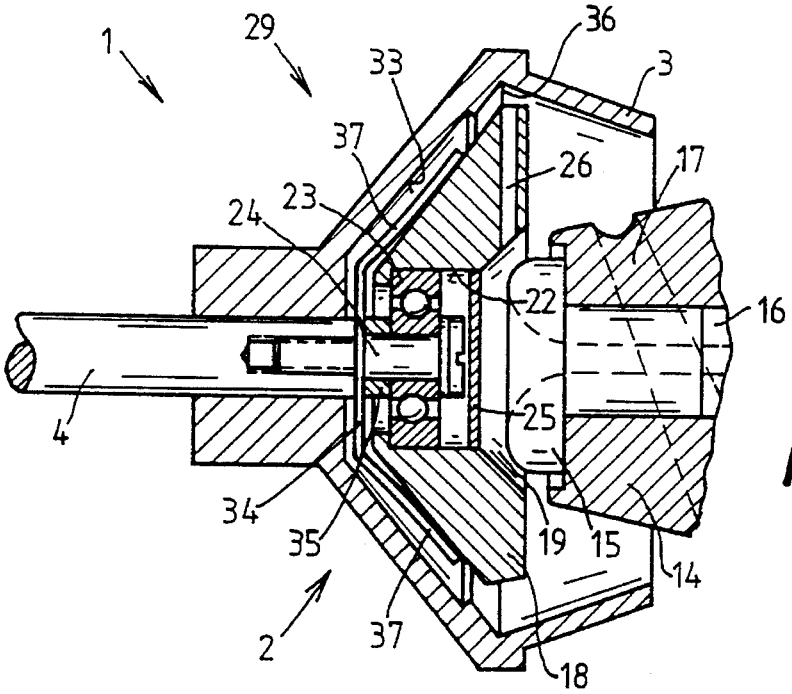
FIG. 3 is a fragmentary, sectional view of a second embodiment of the invention, with a centrifugal coupling in the region of the spinning rotor.
Figure 4:
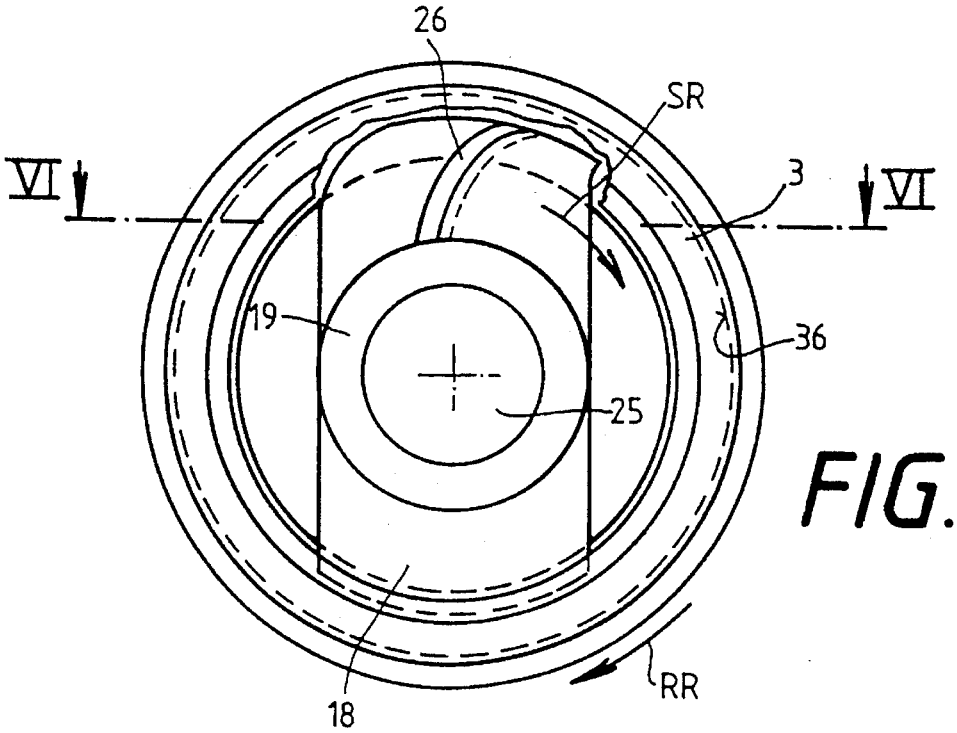
FIG. 4 is a partly broken-away, front-elevational view of a spinning rotor with a spinning insert laid in place.

A coupling device in the form of the centrifugal coupling 29 shown in FIG. 3 is an alternative to the above-described electromagnet coupling. The centrifugal coupling 29 has a spring element 34 which is fixed to the rotor shaft 4. By way of example, the spring element 34 is clamped between a spacer disk 35, which is acted upon by the screw bolt 24, and an end surface of the rotor shaft 4. The spring element 34 has radial spring arms 37 which rest with initial stress on the spinning insert 18 and fix this insert by frictional engagement. Upon acceleration of the spinning rotor 2, the spinning insert 18 is slaved by frictional engagement through the spring arms 37 of the spring element 34, until a certain rpm level is reached. When a threshold value is reached, the spring arms 37 of the spring element 34 bend outward under the influence of mass centrifugal force and press against the rear wall 33 of the rotor. This means that the spinning insert 18 and the spinning rotor 2 are decoupled from that moment on and the spinning insert can rotate freely relative to the spinning rotor 2.

MODE OF OPERATION OF THE DEVICE

It is well known that after a yarn break, open-end rotor spinning apparatuses are restarted by an automatically operating piecer cart. The piecing is performed at a certain piecing rpm which is optimal for the piecing operation. The piecer cart is therefore equipped with a suitable device for measuring the rotor rpm. The device begins by measuring rpm after the spinning apparatus has been cleaned, when the rotor brake is released from the rotor shaft and the rotor runs up to its operating rpm. The actual piecing cycle begins at the predetermined optimal piecing rpm of the rotor.

In order for the pieced yarn to be given a constant thickness and rotation as the run-up of the rotor continues, the fiber insertion and draw-off of yarn must run up to the same extent as that by which the rotor rpm increases.

For the piecing process, the piecer cart therefore assumes the task of inserting fiber into the box, drawing off yarn, and driving a cross-wound bobbin, or cheeses.

Optionally, the piecer cart also assures that the above-described electromagnet coupling 20 will be supplied with current, and thus that the spinning insert 18 is fixed to the spinning rotor 2.

In this way, the spinning insert 18 is accelerated jointly with the spinning rotor 2 to the applicable rotor rpm.

If a centrifugal coupling 29 is used, during the acceleration phase of the spinning rotor 2 the spring element 34 rests on the spinning insert 18, so that this insert is likewise accelerated along with the spinning rotor 2 to the rotor rpm.

Next, as usual, the piecer cart introduces an especially prepared yarn end through the yarn draw-off tube 16 and the yarn draw-off nozzle 15 into the spinning rotor 2. The yarn end travels through the yarn guide channel 26 of the spinning insert 18 which revolves with the spinning rotor 2, reaches a fiber collecting groove 36 of the spinning rotor 2 and there presses against a fiber ring made up of individual fibers. The pieced yarn is drawn off through the yarn draw-off elements 15, 16 and is wound in a non-illustrated winding station into a cheese. In the process, the spinning rotor 2 is accelerated to its operating rpm, which as an example is 110,000 $min^{-}$. During the draw-off, the yarn is located in a protected way in the drag groove 38 of the yarn guide channel 26, with the groove being covered by a protrusion 39. In this way, it is assured that the yarn being produced will not engage additional fibers as it passes through the fiber entry point, which would lead to ballooning.

The coupling devices 20, 29 remain in operation preferably during the entire acceleration phase of the spinning rotor 2. This means that the spinning rotor 2 accelerates the spinning insert 18 up to the level of the operating rpm of the spinning rotor. However, it is also possible to put the coupling device 20, 29 out of operation even before the final operating rpm of the spinning rotor is reached. In that case, the spinning insert 18 is accelerated by the drawn-off yarn from the instantaneous rotor rpm up to the final operating speed of the spinning insert. This operating speed of the spinning insert 18 is the result of the speed of revolution of the fiber collecting groove 36 of the spinning rotor 2 and the applicable yarn draw-off speed.

The invention is not limited to the exemplary embodiments described above. Further variants are conceivable, particularly with respect to the coupling device or the embodiment of the spinning insert.

What is essential to the invention is that the spinning insert, during the acceleration phase of the spinning rotor, is initially accelerated jointly with the spinning rotor, and then is uncoupled from it no later than when the rotor operating rpm is reached. In other words, it must be possible for the correct operating rpm of the spinning insert to be established automatically by means of the yarn.

I claim:

1. An open-end spinning apparatus, comprising:

a rotor housing;

a spinning rotor revolving in said rotor housing;

a spinning insert being disposed coaxially to said rotor housing and being rotatably supported relative to said spinning rotor, said spinning insert having a yarn guide channel enabling entrainment of said spinning insert by a yarn during normal spinning operation; and a coupling device for fixing said spinning insert to said spinning rotor only during a run-up of said rotor.

2. The open-end spinning apparatus according to claim 1, wherein said yarn guide channel has an entry side being curved in a direction of rotation of said spinning insert and has a drag groove for protected reception of a resultant yarn.

3. The open-end spinning apparatus according to claim 2, including a protrusion partly covering said drag groove of said yarn guide channel.

4. The open-end spinning apparatus according to claim 1, wherein said coupling device connects said spinning insert to said spinning rotor by frictional engagement during the run-up phase of said spinning rotor.

5. The open-end spinning apparatus according to claim 1, wherein said spinning insert is freely rotatable inside said spinning rotor when the spinning apparatus is running at an operating rpm.

6. The open-end spinning apparatus according to claim 1, wherein said coupling device is a centrifugal coupling fixing said spinning insert to said spinning rotor below a given rpm level and releasing said spinning insert when a threshold value is reached.

7. The open-end spinning apparatus according to claim 6, wherein said spinning rotor has a rotor shaft, and said centrifugal coupling has a spring element being secured to said rotor shaft and having spring arms resting with initial stress on said spinning insert.

8. The open-end spinning apparatus according to claim 7, wherein said spring arms of said spring element resting on said spinning insert are bent open under the influence of mass centrifugal force when a given rpm level is reached.

9. The open-end spinning apparatus according to claim 1, wherein said coupling device is an electromagnet coupling.

10. The open-end spinning apparatus according to claim 9, wherein said electromagnetic coupling is supplied with current during the run-up phase of said spinning rotor and fixes said spinning insert to said spinning rotor.

11. The open-end spinning apparatus according to claim 10, wherein said spinning rotor has a rear wall, and said electromagnet coupling has a magnet coil permanently installed on said rotor housing and a ferromagnetic slaving element being secured to said spinning insert and having slaving tongues pressing against said rear wall when said magnet coil is supplied with current, for fixing said spinning insert to said spinning rotor through frictional engagement.

12. The open-end spinning apparatus according to claim 11, wherein said slaving tongues of said slaving element are diametrically opposed and are deflectable in a functional direction.

13. The open-end spinning apparatus according to claim 1, wherein said spinning rotor has an axis, and said spinning insert has a yarn guide channel extending essentially radially to said rotor axis.

14. The open-end spinning apparatus according to claim 1, including a yarn draw-off nozzle protruding partly into a recess formed in a front surface of said spinning insert.

* * * * *